US009140271B2

(12) United States Patent
Sugimoto et al.

(10) Patent No.: US 9,140,271 B2
(45) Date of Patent: Sep. 22, 2015

(54) IMPELLER OF CENTRIFUGAL COMPRESSOR

(75) Inventors: Koichi Sugimoto, Tokyo (JP); Kenichiro Iwakiri, Tokyo (JP); Isao Tomita, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 375 days.

(21) Appl. No.: 13/381,064

(22) PCT Filed: Aug. 10, 2010

(86) PCT No.: PCT/JP2010/063583
§ 371 (c)(1),
(2), (4) Date: Jan. 19, 2012

(87) PCT Pub. No.: WO2011/067965
PCT Pub. Date: Jun. 9, 2011

(65) Prior Publication Data

US 2012/0328444 A1 Dec. 27, 2012

(30) Foreign Application Priority Data

Dec. 2, 2009 (JP) ..... 2009-274645

(51) Int. Cl.
*F04D 29/38* (2006.01)
*F04D 29/28* (2006.01)
(Continued)

(52) U.S. Cl.
CPC ..... *F04D 29/284* (2013.01); *F04D 29/30* (2013.01); *F04D 29/681* (2013.01)

(58) Field of Classification Search
USPC ..... 416/175, 179, 180, 182, 183, 185, 188, 416/203, 223 B; 415/198.1, 218.1; 164/35
See application file for complete search history.

(56) References Cited

U.S. PATENT DOCUMENTS 2,753,808 A * 7/1956 Kluge ..... 416/183
4,093,401 A * 6/1978 Gravelle ..... 416/185
(Continued)

FOREIGN PATENT DOCUMENTS

CN 1842657 A 10/2006
JP 10-213094 A 8/1998
(Continued)

OTHER PUBLICATIONS

Chinese Office Action dated Dec. 24, 2013 issued in the corresponding Chinese Application No. 201080029404.3 with an English translation.
(Continued)

*Primary Examiner* — Edward Look
*Assistant Examiner* — Aaron R Eastman
(74) *Attorney, Agent, or Firm* — Birch, Stewart, Kolasch & Birch, LLP.

(57) ABSTRACT

Interference of a leakage vortex flow generated at the tip end side of the full blade with the leading edge of the splitter blade is avoided and high pressure ratio and enhanced efficiency can be achieved. A throat of am impeller is formed so that a distance from a leading edge of a rear side full blade on the rear side of the rotation direction of the compressor to a front side full blade adjacent to the rear side full blade is minimized, and the leading edge of the splitter blade is placed in a fluid flow streaming along the flow passage between the mutually adjacent full blades, on the downstream side of a leakage vortex line formed to connect the middle location of the throat to the leading edge of the front side full blade.

5 Claims, 7 Drawing Sheets

(51) Int. Cl.
*F04D 29/30* (2006.01)
*F04D 29/68* (2006.01)

(56) References Cited

U.S. PATENT DOCUMENTS

| | | | | |
|---|---|---|---|---|
| 4,502,837 | A * | 3/1985 | Blair et al. | 415/198.1 |
| 5,120,196 | A * | 6/1992 | By et al. | 416/180 |
| 6,508,626 | B1 * | 1/2003 | Sakurai et al. | 416/180 |
| 6,588,485 | B1 | 7/2003 | Decker | |
| 6,905,310 | B2 * | 6/2005 | Kawamoto et al. | 416/175 |
| 2006/0034695 | A1 * | 2/2006 | Hall et al. | 416/213 R |
| 2007/0031261 | A1 * | 2/2007 | Lombard et al. | 416/203 |
| 2013/0195608 | A1 * | 8/2013 | Gharaibah et al. | 415/1 |

FOREIGN PATENT DOCUMENTS

| | | | | |
|---|---|---|---|---|
| JP | 2002-21574 | A | 1/2002 | |
| JP | 2002-516960 | A | 6/2002 | |
| JP | 2002-332992 | A | 11/2002 | |
| JP | 2004-52754 | A | 2/2004 | |
| JP | 3876195 | B2 | 1/2007 | |
| JP | 2008-196381 | A | 8/2008 | |
| WO | WO 9002265 | A1 * | 3/1990 | F04D 17/10 |

OTHER PUBLICATIONS

Chinese Office Action for Chinese Application No. 201080029404.3, dated Jan. 16, 2015, along with an English translation.

* cited by examiner

IMPELLER OF CENTRIFUGAL COMPRESSOR

BACKGROUND OF THE INVENTION

1. Field of the Invention

The present invention relates to an impeller of a centrifugal compressor used for the turbocharger of a vehicle use, a marine use and the like; the invention especially relates to a geometry of a splitter blade provide between adjacent full blades, the geometry being related to the inlet part of the splitter blade.

2. Background of the Invention

In the centrifugal compressor used for the turbocharger of a vehicle use, a marine use and the like, the fluid streaming through the centrifugal compressor receives kinetic energy via the rotation movement of the impeller; and, the fluid is discharged toward the outside in the radial direction and obtains pressure increase via centrifugal force. The centrifugal compressor is required high pressure ratio and high efficiency in the wide operation zone; hence, as shown in FIG. 9, an impeller 05 that is provided with a splitter blade 03 between adjacent full blades 01 is often made use of. And, various arrangements are contrived regarding the blade geometry.

As shown in FIG. 9 and FIG. 10 (that shows a part of a cross-section in the radial direction regarding the impeller depicted in FIG. 9), in the impeller 05 provided with the splitter blade 03, the full blade 01 and the splitter blade 03 are arranged on the surface of a hub 07 by turns. In a case of a general splitter blade 03, the geometry of the splitter blade is formed by simply cutting off the upstream side of the full blade 01.

As shown in FIG. 11 (that shows the A-A curve cross-section in FIG. 10), in this general splitter blade, the leading edge (LE2) of the splitter blade 03 is arranged on the downstream side of the leading edge (LE1) of the full blade 01, by a prescribed distance; the trailing edges (TE) of the splitter 03 is arranged in accordance with the trailing edges (TE) of the full blade. The direction of the leading edge blade angle θ (that is depicted as the angle which the leading edge direction forms with the rotation axis direction G of the impeller 05) of the splitter blade 03 is established so as to be the same as the direction of the fluid flow streaming along the fluid passage between the adjacent full blades 01.

On the other hand, as shown in FIG. 11, when the geometry regarding the leading edge of the splitter blade 03 is designed and formed simply as a the geometry of full blade 01 whose upstream side is cut-off so that the splitter blade is formed from a middle point in the hoop direction between the adjacent full blades 01 toward the downstream side, a difference is generated between the throat area A1 on the blade pressure surface Sa side of an full blade adjacent to the splitter blade 03 and the throat area A2 on the blade suction surface Sb side of the another full blade adjacent to the splitter blade 03; and, the throat area A1 becomes smaller than the throat area A2 (A1<A2). Hence, the unevenness is developed regarding the flow rate of the fluid streaming through the flow passage on the throat A1 side and the flow rate of the fluid streaming through the flow passage on the throat A2 side; namely, the flow rate can be no longer evenly allotted to the fluid passages on the throat A1 side and the throat A2 side. Accordingly, the unevenness regarding the blade surface loads is developed; the flow passage loss is increased; and, there arises a problem that the enhancement of the impeller efficiency is prevented. Incidentally, the throat area means the cross section area of a cross section where the distance from the leading edge of the splitter blade to the blade pressure surface or the blade suction surface regarding the full blade 01 becomes the minimum distance, as shown in FIG. 11.

Consequently, Patent Reference 1 (JP1998-213094) discloses a technology in which the leading edge blade angle θ of the splitter blade 09 is increased to an angle θ+Δθ (i.e. the blade angle θ is increased toward the fluid flow direction by the angle increment Δθ), as shown in FIG. 12; in other words, the leading edge comes near to toward the blade suction surface Sb of the full blade 01, and the throat areas A1 and A2 of the passage on both the sides of the splitter blade 09 made equal to each other (A1=A2). Patent Reference 1 comes up with such a contrivance as described above.

Further, Patent Reference 2 (JP3876195) also discloses a technology in which the leading edge of the splitter blade is inclined toward the blade suction surface of the full blade However, as shown in Patent Reference 1 (FIG. 12), when the leading edge blade angle θ of the splitter blade 09 is increased to an angle θ+Δθ, it is afraid that a separation flow may occur at the leading edge of the splitter blade 09 whose leading edge inclination angle is increased, or at the blade suction surface Sb of the full blade 01. Further, there arises a problem that, even when the throat area A1 on the blade pressure surface side of the full blade 01 is made equal to the throat area A2 on the blade suction surface side of the full blade 01 (A1=A2), the speed of the flow in the flow passage on the throat A1 side becomes different from the speed of the flow in the flow passage on the throat A2 side, and the even allotment regarding the fluid flow rates in both the flow passages become difficult.

In this way, the flow speed on one side of the splitter blade 09 (i.e. on the blade pressure surface side of the full blade 01) becomes different from the flow speed on the other side of the splitter blade 09 (i.e. on the blade suction surface side of the full blade 01); accordingly, the fluid entering the space between a full blade and the adjacent blade is distributed to both the passages so that the speed of the flow on the blade suction side becomes higher than that on the blade pressure side. Thus, even when the throat areas on both the sides of the splitter blades 09 are geometrically equal to each other, the flow speed on the blade suction surface side is higher than the flow speed on the blade pressure surface side. Accordingly, the flow rate on the blade suction surface side becomes greater than the flow rate on the blade pressure surface side; thus, the unevenness of the fluid flow rates in both the flow passages is caused. And, the even distribution of the flow rates can be no longer achieved; further, the blade surface loads become uneven and the flow passage loss is increased. And, there arises a problem that the enhancement of the impeller efficiency is hindered.

Consequently, Patent Reference 3 (JP2002-332992) discloses a technology regarding the subject matter. According to Patent Reference 3, as shown in FIG. 13, the leading edge of the splitter blade 011 is planned to be shifted toward the blade suction surface side of the full blade 01 without changing the leading edge blade angle θ; thus, the throat area A1 becomes greater than the throat area A2 (A1>A2). In this way, it is attempted to make uniform the flow rates of the fluid streaming along both the sides of the splitter blades 011.

REFERENCES

Patent References

Patent Reference 1: JP1998-213094
Patent Reference 2: JP3876195

Patent Reference 3: JP2002-332992

SUMMARY OF THE INVENTION

Subjects to be Solved

In any one of Patent References 1 to 3, the blade geometry is improved on the premise that the fluid flow between a blade and the adjacent blade streams along the full blade; namely, the blade geometry improvement is performed in paying attention to the distributed flow rate regarding the fluid flow streaming through the passages divided by the splitter blade.

However, especially in a case of an open type impeller that is provided with a tip clearance around the tip of the impeller blade, the flow field becomes complicated; the conventional blade geometry that is not compatible with the complicated internal flow eventually achieves insufficient impeller performance.

Hence, the complicated internal flow is investigated by numerical analyses; according to the analyses, the following results become clear: a leakage vortex is generated at the tip of full blade leading edge (the tip of the blade height direction from the hub toward the impeller casing) and the generated leakage vortex reaches the tip of splitter blade leading edge (the tip of the blade height direction from the hub toward the impeller casing) (cf. the tip end leakage flow W in FIG. 8).

The leakage vortex does not flow along the full blade; and, the leakage vortex is a fluid flow in which low energy fluid are accumulated. Thus, when the leakage vortex interferes with the leading edge of the splitter blade, the dissipation loss due to the flow separation or the vortex structure is caused, and the dissipation loss is increased.

In other words, in the conventional impeller structure, the countermeasure against the interference of the leakage vortex generated at the tip of full blade leading edge with the splitter blade leading edge is not taken; accordingly, sufficient impeller performance is not achieved.

In view of the problems as described above, the present invention aims at providing an impeller of a centrifugal compressor, the impeller including but not limited to: a plurality of full blades provided from the fluid inlet side to the fluid outlet side, the full blades being arranged side by side; a plurality of splitter blades, each splitter blade being provided between a full blade and the adjacent full blade so that each splitter blade is arranged from a part way of the fluid flow passage between the adjacent full blades to the outlet side of the fluid flow passage, wherein the interference of the leakage vortex generated at the tip end side of the full blade with the leading edge of the splitter blade can be evaded so that high pressure ratio and enhanced efficiency can be achieved.

Means to Solve the Subjects

In order to settle the problems as described above, the present invention provides an impeller of a compressor, the impeller including, but not limited to:

a plurality of full blades provided from an inlet to an outlet on the hub surface, the full blades being provided side by side;

a plurality of splitter blades provided in a flow passage formed between a pair of the mutual adjacent full blades from a part way of the flow passage to the outlet side, wherein a throat is formed so that a distance from a leading edge of a rear side full blade located on the rear side of the rotation direction of the compressor to a front side full blade adjacent to the rear side full blade and located on the front side of the rotation direction is minimized, and the leading edge of the splitter blade is placed in a fluid flow streaming along the flow passage the full blades, on the downstream of a leakage vortex line formed to connect the middle location of the throat to the leading edge of the front side full blade.

According to the invention as described above, a plurality of full blades provided from the fluid inlet side to the fluid outlet side on the hub surface, the full blades being provided side by side;

a plurality of splitter blades provided in the flow passage formed between a pair of the mutual adjacent full blades from a part way of the flow passage to the outlet side, wherein a throat is formed so that a distance from a leading edge of a rear side full blade located on the rear side of the rotation direction of the compressor to a front side full blade adjacent to the rear side full blade and located on the front side of the rotation direction is minimized, and the leading edge of the splitter blade is placed in a fluid flow streaming along the flow passage the full blades, on the downstream side of a leakage vortex line formed to connect the middle location of the throat to the leading edge of the front side full blade.

In this way, the interference of the leakage vortex generated at the tip end side (the casing side) of the leading edge of the full blade with the leading edge of the splitter blade can be avoided.

In other words, according to the numerical analysis results, the leakage vortex generated at the leading edge of the full blade streams along the leakage vortex line that is formed so as to pass through the leading edge of the front side full blade and the middle location of the throat; thereby, the throat is a throat connecting the leading edge of the rear side full blade and the surface of the front side full blade so as to form a minimal distance; and, the rear side full blade is the full blade that is located on the rear side regarding the impeller rotation direction, out of the adjacent full blades, while the front side full blade is the full blade that is located on the front side regarding the impeller rotation direction, out of the adjacent full blades. Based on the findings of the numerical analyses, the location of the leading edge of the splitter blade is determined in this invention.

Hence, the leading edge of the splitter blade is placed on the downstream side of the leakage vortex line with regard to the fluid flow in the flow passage. Therefore, the leakage vortex can be prevented from interfering with the tip end side of the leading edge of the splitter blade; the flow separation or the further generated leakage vortex due to the interference can be prevented. Thus, the apprehension that the flow separation or the leakage vortex promotes the flow loss formation and the efficiency deterioration is caused can be eliminated. In this way, the impeller efficiency deterioration can be prevented, and the enhancement regarding pressure ratio and efficiency can be achieved.

A preferable embodiment of the above-described present invention is the impeller of the centrifugal compressor, wherein the tip end side in the blade height direction regarding the leading edge of the splitter blade is inclined toward the front side full blade.

In a case of conventional impeller, the leakage vortex generated at the tip end side (the casing side) of the leading edge of the full blade interferes mainly with the tip end side of the leading edge of the splitter blade. On the other hand, according to the above-described configuration, the leading edge of the splitter blade further inclined toward the front side full blade. Hence, the interference of the leakage vortex can be further surely evaded.

When the leading edge of the splitter blade is moved toward the downstream side, the length of the splitter blade becomes shorter; hence, the inherent function of the splitter blade for enhancing the pressure ratio as well as the efficiency is deteriorated. On the other hand, according to the above-described configuration, while the length of the splitter blade can be maintained, the interference of the leakage vortex can be effectively avoided.

Another preferable embodiment of the above-described present invention is the impeller of the centrifugal compressor, wherein the inclination angle toward the front side full blade is increased by 5 to 8 degrees with regard to the inclination angle along the rear side full blade.

According to the results of the numerical analyses, when the to-be-increased angle is smaller than 5 degrees, the effect of the inclination increase for evading the interference of the leakage vortex flow can be no longer expected. Further, when the to-be-increased angle is greater than 8 degrees, the inclined part forms flow resistance for the fluid flow streaming through the flow passage between the splitter blade and the front side full blade. Thus, when the to-be-increased angle is out of the range of 5 to 8 degrees, a problem may be caused. In this way, the to-be-increased angle is preferably within a range of 5 to 8 degrees.

Another preferable embodiment of the above-described present invention is the impeller of the centrifugal compressor, wherein the leading edge of the splitter blade is shifted toward the front side full blade so that the leading edge is closer to the front side full blade in the hoop direction than the middle location of the front side full blade and the rear side full blade.

According to the above-described configuration, in addition to the evasion of the interference of the leakage vortex flow, the even allotment of the flow rate into the fluid flow passages into which the flow passage between the adjacent full blades is divided by the splitter blade can be realized.

In a case of conventional impeller, the flow rates of the flow passages on both the side of the splitter blade is different from each other; namely, the flow speed on the blade pressure surface side of the full blade differs from the flow speed on the blade suction surface side of the full blade. Thus, the fluid flow entering the flow passage between the adjacent full blades is distributed into the fluid passages on both the sides of the splitter blades so that the higher speed flow is centered mainly on the flow passage on the blade suction surface side. Thus, even when the cross section areas are geometrically equalized as to both the divided flow passages, the flow speed on the blade suction surface side is higher than the flow speed on the blade pressure surface side. Accordingly, the flow rate on the blade suction surface side becomes greater than the flow rate on the blade pressure surface side; thus, the unevenness of the fluid flow rates in both the flow passages is caused. And, the even distribution of the flow rates can be no longer achieved; further, the blade surface loads become uneven and the flow passage loss is increased. And, there arises a problem that the enhancement of the impeller efficiency is hindered.

However, in order to overcome the above-described problem, according to the above-described invention, the leading edge of the splitter blade is shifted toward the front side full blade; namely, the leading edge of the splitter blade is shifted toward the suction side of the full blade so that the flow passage on the suction side is narrowed. In this way, the even allotment of the flow rate into the fluid flow passages into which the flow passage between the adjacent full blades is divided by the splitter blade can be realized.

Effects of the Invention

The present invention can provide the impeller of a centrifugal compressor, the impeller including, but not limited to:

a plurality of full blades provided from the fluid inlet side to the fluid outlet side on the hub surface, the full blades being provided side by side;

a plurality of splitter blades provided in the flow passage formed between a pair of the mutual adjacent full blades from a part way of the flow passage to the outlet side, wherein a throat is formed so that a distance from a leading edge of a rear side full blade located on the rear side of the rotation direction of the compressor to a front side full blade adjacent to the rear side full blade and located on the front side of the rotation direction is minimized, and the leading edge of the splitter blade is placed in a fluid flow streaming along the flow passage the full blades, on the downstream side of a leakage vortex line formed to connect the middle location of the throat to the leading edge of the front side full blade.

Accordingly, the interference of the leakage vortex generated at the tip of the leading edge of the full blade with the leading edge of the splitter blade can be avoided. Thus, the present invention can provide the impeller of the centrifugal compressor that achieves high pressure ratio and high efficiency.

DETAILED DESCRIPTION OF THE PREFERRED MODES

First Mode

Hereafter, the present invention will be described in detail with reference to the modes or embodiments shown in the figures. However, the dimensions, materials, shape, the relative placement and so on of a component described in these modes or embodiments shall not be construed as limiting the scope of the invention thereto, unless especially specific mention is made.

Figure 1:
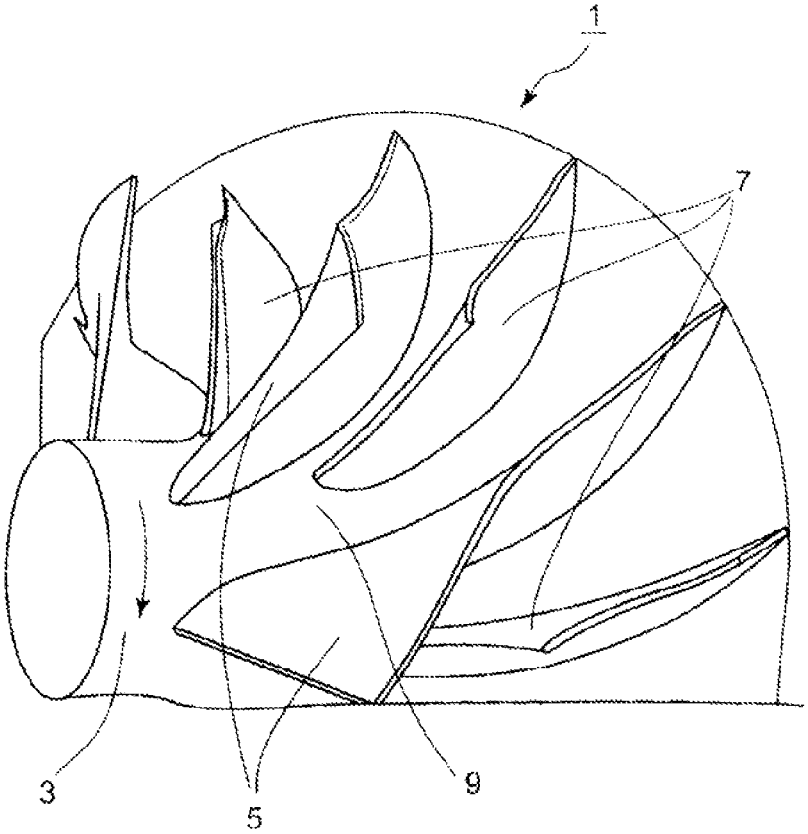
FIG. 1 shows a bird view of major parts of an impeller of a centrifugal compressor, the impeller being provided with a splitter blade according to the present invention.

FIG. 1 shows a bird view of major parts of an impeller of a centrifugal compressor, the impeller being provided with a splitter blade according to the present invention. An impeller 1 is provided with a plurality of full blades 5 and a plurality of splitter blades 7, the blades 5 and 7 being set-up on the outer surface of a hub 3 attached to a rotor shaft (not shown); a splitter blade is arranged between a pair of adjacent full blades so that a splitter blade and a full blade are alternately placed with a constant pitch in the hoop direction. In relation to the fluid flow direction, the length of the splitter blade is shorter than the length of the full blade; the splitter blade is arranged in a flow passage 9 formed between a full blade 5 and the adjacent full blade 5; and, the splitter blade is arranged from a location on a part way of the flow passage 9 to the flow outlet part.

Figure 2:
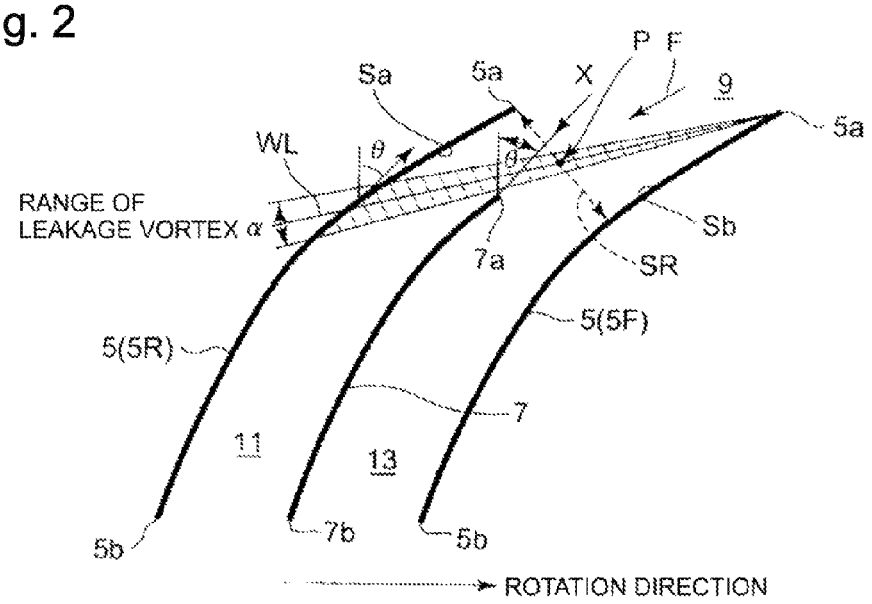
FIG. 2 explains the relationship between a splitter blade and a full blade according to a first mode of the present invention, in a cross section.
Figure 10:
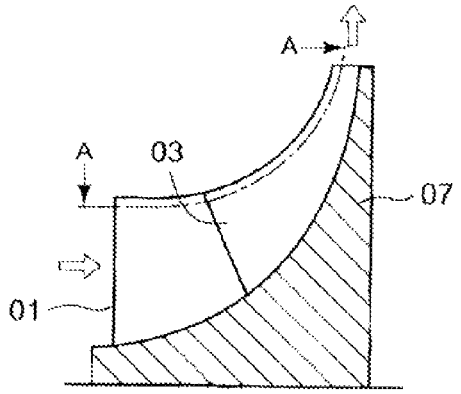
FIG. 10 explains a conventional technology.
Figure 11:
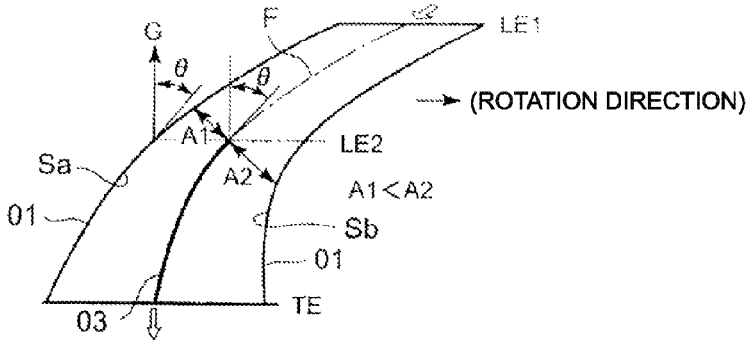
FIG. 11 explains a conventional technology.
Figure 12:
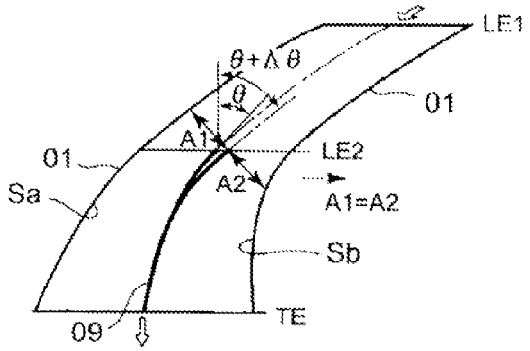
FIG. 12 explains a conventional technology.
Figure 13:
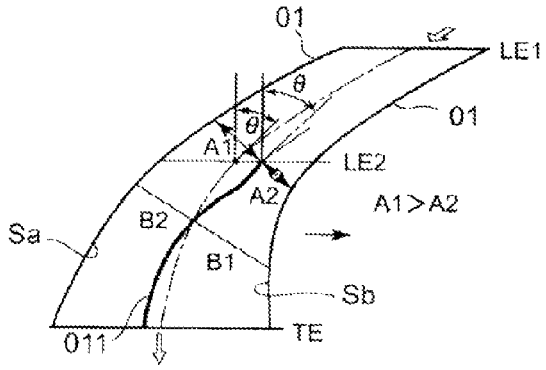
FIG. 13 explains a conventional technology.

FIG. 2 shows the geometric relationship between the splitter blade 7 and the full blade 5 in a cross section cut by a curved surface along a longitudinal direction regarding the blades, the curved surface corresponding to the A-A curve cross section depicted in FIG. 10. In other words, the geometry in the cross section is depicted along the tip end curve. In addition, the impeller rotates along the arrow direction.

A leading edge 7*a* as a flow inlet edge of the splitter blade is placed on the downstream side of a leading edge 5*a* as a flow inlet edge of the full blade; the trailing edge 7*b* of the splitter blade 7 is placed in accordance with the trailing edge 5*b* of the full blade 5.

Further, the flow passage 9 formed between a blade pressure surface Sa of a full blade 5 and a blade suction surface Sb of the adjacent full blade 5 is divided equally into two passages by a splitter blade 7 in the hoop direction; namely, a flow passage 11 is formed between the splitter blade 7 and the wall surface on the blade pressure surface side Sa of the full blade 5 whereas a flow passage 13 is formed between the splitter blade 7 and the wall surface on the blade suction surface side Sb of the full blade 5.

Further, the profile of the splitter blade 7 is arranged in accordance with the profile of the full blade 5; and, the inclination angle θ of the leading edge 7*a* is the same as the inclination angle at the corresponding location of the full blade 5.

The impeller 1 as described above forms an open type impeller whose full blade 5 and splitter blade 7 are housed in a casing (not shown); thereby, a tip end clearance is provided between the full blade 5 and the casing as well as between the splitter blade 7 and the casing. Hence, a tip end leakage flow W is generated so that the tip leakage flow streams through the tip clearance between the casing and the tip side of the leading edge part of the full blade 5, from the blade pressure surface side toward the blade suction side corresponding to the blade pressure side of the full blade 5.

Figure 8:
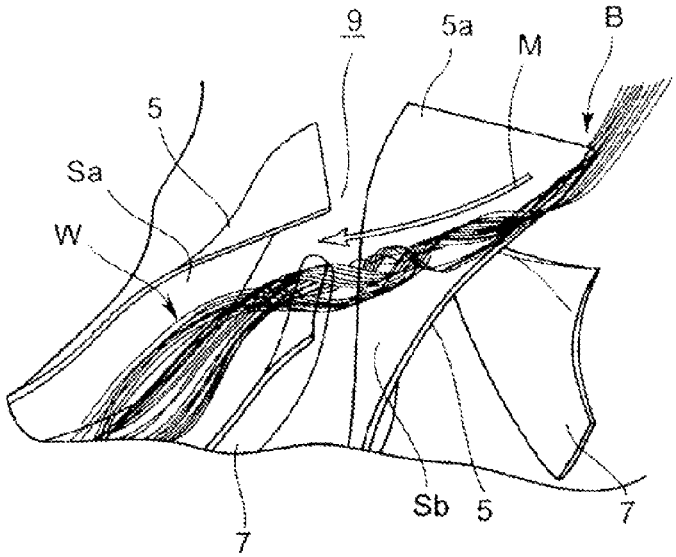
FIG. 8 shows a numerical analysis result regarding the blade-tip end leakage flow that is generated at the tip end side of the full blade, and formed around and through the tip end side of the leading edge of the splitter blade.
Figure 9:
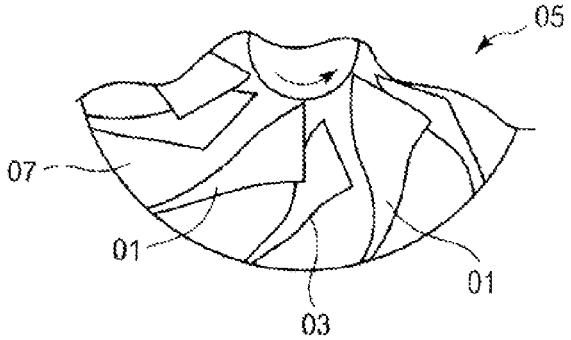
FIG. 9 explains a conventional technology.

The tip leakage flow W has an influence on the fluid flow near the leading edge 7*a* of the splitter blade 7; numerical analyses regarding the condition of the tip end leakage flow W are performed. An example of the numerical analysis result is shown in FIG. 8.

A tip leakage flow streaming through the tip clearance part B between the casing and the tip end side of the leading edge 5*a* of the full blade 5 is generated. The tip leakage flow accompanies a strong vortex flow (a tip leakage vortex), and functions as a block against the fluid flow along the full blade 5. Hence, the fluid flow in the neighborhood of the leading edge 7*a* of the splitter blade 7 no longer streams along the full blade 5; thus, a drift current M directed toward the leading edge 7*a* of the splitter blade 7 occurs around the vortex as a core.

Figure 7:
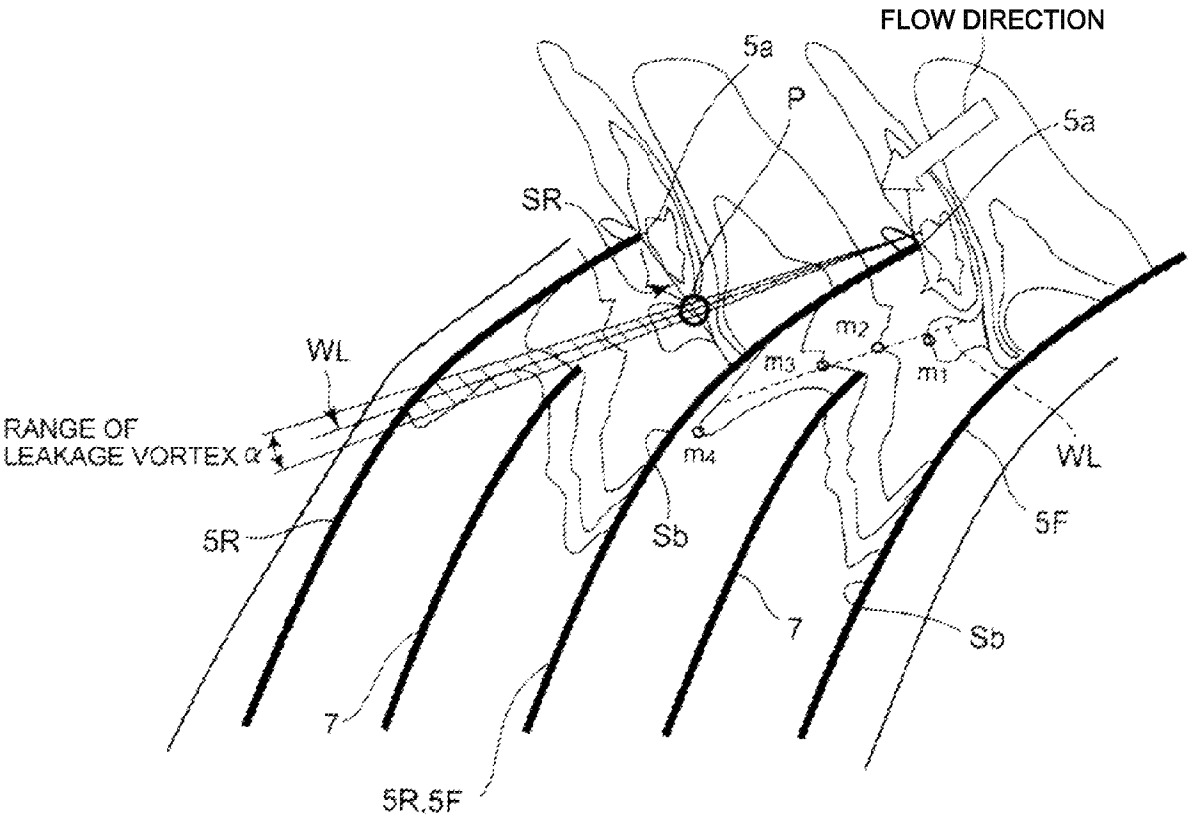
FIG. 7 explains a numerical analysis result regarding the fluid flow streaming among the impeller blades, the numerical analysis result being shown by use of a Mach-number distribution expression.

In order to further investigate the conditions regarding the tip leakage flow, the velocity distribution transformed in a Mach-number expression is analyzed in relation to the area between the adjacent full blades 5F and 5R as shown in FIG. 7; thereby, the alpha-numeral 5F denotes the full blade that is placed on the front side regarding the rotation direction of the impeller 1, whereas the alpha-numeral 5R denotes the full blade that is placed on the rear side regarding the rotation direction.

As shown in FIG. 7, in the Mach-number distribution, the points m1, m2, m3 and m4 are located on a Mach-number boundary line; each of the points m1, m2, m3 and m4 is located also on an area (a contour area) curve. And, the area protrudes with a valley shape in the next area. Thus, it is understood that a disturbance regarding flow velocity appears. Further, it can be ascertained that the tip end leakage flow W streams along a dotted line on which the points m1, m2, m3 and m4 are located in order. Thus, the line along which the vortex flow generated by the tip leakage flow W streams is defined as a leakage vortex line WL.

Further, in order to recognize and define the location of the leakage vortex line WL, numerical analyses are further performed. As shown in FIG. 7, the result of the analyses reveals that the leakage vortex line WL can be defined as a line connecting the leading edge 5*a* of a full blade and a central point P of what they call the throat SR; thereby, the throat SR forms a minimal distance from the leading edge 5*a* of the rear side full blade 5R to the blade suction surface Sb of the front side full blade 5F adjacent to the rear side full blade 5R, the full blade 5F being on the front side of the full blade 5R regarding the rotation direction.

Accordingly, in the neighborhood of the leakage vortex line WL, the leakage vortex is a fluid flow in which low energy fluid are accumulated. Thus, when the leakage vortex interferes with the leading edge 7*a* of the splitter blade 7, there may be an apprehension that the dissipation loss caused by flow separation or vortex generation is increased. According, it becomes necessary to place the leading edge 7*a* of the splitter blade 7 so as to not interfere with the leakage vortex.

In other words, as shown in FIG. 7, a range whose center line is the leakage vortex line WL is established so that the angle α is, for instance, 4 to 5 degrees; the location of the leading edge 7*a* of the splitter blade 7 is determined so that the location is shifted toward the downstream side of the fluid flow streaming between the front side full blade 5F and the rear side full blade 5R, and the range no longer interferes with the location of the leading edge 7*a*. In this way, the high pressure ratio and the enhanced efficiency regarding the impeller can be achieved.

In addition, in the numerical analyses, the computation regarding the vorticity as a physical quantity is performed so as to identify the extent of the vortexes; a result of the vorticity computation can determine the range of the above-described angle α in response to the width regarding the analyzed vorticity. In other words, the range of the angle α is established so that the range becomes minimal and the leakage vortex no longer brings an undesirable influence.

In addition, when the splitter blade 7 is seen in the X-arrow direction of the FIG. 2 regarding the first mode, the leading edge 7*a* of the splitter blade 7 is installed upright in the vertical direction, on the outer surface of the hub 3, as shown in FIG. 6(*a*).

According to the first mode as described above, the location of the leading edge 7*a* of the splitter blade 7 is arranged on the downstream side with respect to the leakage vortex line WL; in this way, the leakage vortex no longer interferes with the leading edge 7*a* of the splitter blade 7. Thus, the problems of flow separation and additionally caused vortexes are prevented. Accordingly, the efficiency deterioration due to the flow separation and the additionally caused vortexes can be evaded. As a result, the efficiency deterioration regarding the impeller 1 can be prevented. Hence, the higher-pressure ratio and the higher efficiency regarding the impeller can be achieved.

Second Mode

Figure 3:
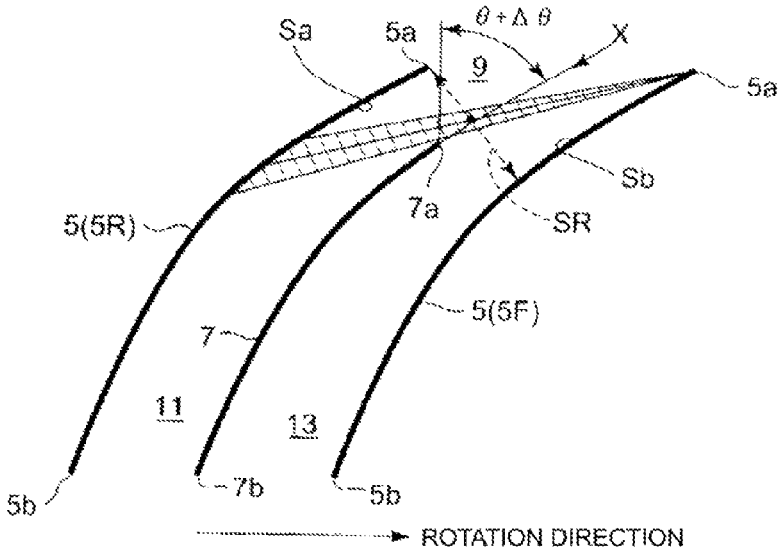
FIG. 3 explains the relationship between a splitter blade and a full blade according to a second mode of the present invention, in a cross section.

In the next place, based on FIG. 3, a second mode of the present invention is now explained.

In this second mode, the leading edge 7*a* of the splitter blade 7 is placed so as to be not within the leakage vortex range of the angle α, the leakage vortex range having been explained in the first mode; in addition, in the second mode, the leading edge 7*a* of the splitter blade 7 is inclined toward the full blade 5F at the tip end side of the leading edge 7*a* in the height direction; namely, the leading edge 7*a* part of the splitter blade 7 on the casing side is inclined toward the full blade 5F.

In the first mode, the inclination angle regarding the profile of the splitter blade 7 is arranged in accordance with the inclination angle regarding the profile of the full blade; the inclination angle θ of the leading edge 7*a* is established as the same inclination angle θ of the rear side full blade 5R as shown in FIG. 2. On the other hand, in this second mode, the inclination angle θ is increased by Δθ into an angle θ+Δθ. Hereby, the inclination increment Δθ is preferably within a range of 5 to 8 degrees.

According to the results of the numerical analyses, when the angle increment Δθ is smaller than 5 degrees, the effect of the inclination increase for evading the interference of the leakage vortex flow from can be no longer expected. Further, when the angle increment Δθ is greater than 8 degrees, the inclined part forms flow resistance for the fluid flow streaming through the flow passage 13. Thus, when the inclination increment is out of the range of 5 to 8 degrees, a problem may be caused. In this way, the inclination increment Δθ is preferably within a range of 5 to 8 degrees.

As described above, the leakage vortex generated on the tip side (the casing side) of the leading edge 5*a* of the full blade 5 interferes mainly with the tip of the leading edge 7*a* of the splitter blade 7; accordingly, by increasing the inclination angle of the leading edge 7*a* at the tip regarding the splitter blade 7 by an additional inclination angle increment toward the full blade 5F, the interference of the leakage vortex can be further surely evaded.

When the leading edge 7*a* of the splitter blade 7 is moved toward the downstream side in the fluid flow streaming between the front side full blade 5F and the rear side full blade 5R, the length of the splitter blade becomes shorter; in this event, the inherent function of the splitter blade for enhancing the pressure ratio as well as the efficiency is deteriorated. According to the second mode, the length of the splitter blade can be maintained while the interference of the leakage vortex can be evaded. Hence, even when the impeller 1 is downsized, the effect for evading the leakage vortex flow interference can be appropriately achieved.

In addition, when the splitter blade 7 is seen in the X-arrow direction of the FIG. 3, the leading edge 7*a* of the splitter blade 7 is set up so as to be inclined toward the front side full blade 5F, as shown in FIG. 6(*b*).

Third Mode

Figure 4:
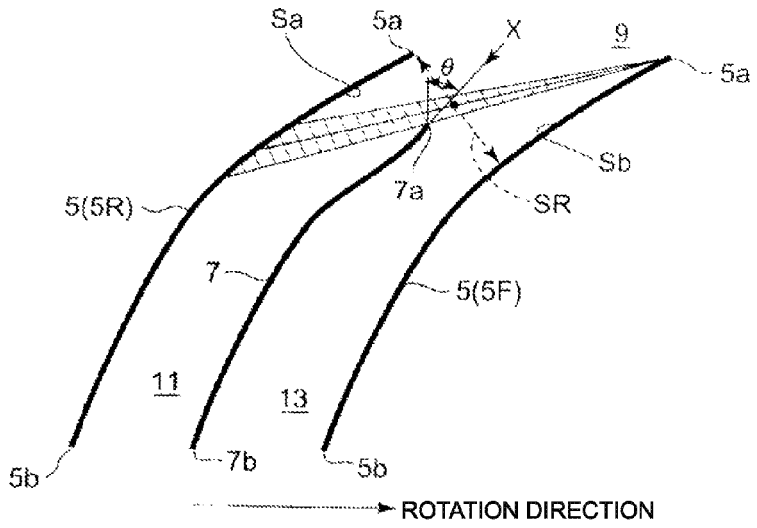
FIG. 4 explains the relationship between a splitter blade and a full blade according to a third mode of the present invention, in a cross section.

In the next place, based on FIG. 4, a third mode of the present invention is now explained.

In this third mode, the leading edge 7*a* of the splitter blade 7 is placed so as to be not within the leakage vortex range of the angle α, the leakage vortex range having been explained in the first mode; in addition, in the third mode, the leading edge 7*a* of the splitter blade 7 is placed so as to be shifted toward the front side full blade 5F along the hoop direction from the middle location of the front side full blade 5F and the rear side full blade 5R.

In other words, when the splitter blade 7 is seen in the X-arrow direction of the FIG. 4, the leading edge 7*a* of the splitter blade 7 is installed upright in the vertical direction and moved toward the front side full blade 5F by a length increment ΔL from the middle location of the adjacent full blades, on the outer surface of the hub 3, as shown in FIG. 6(*c*).

According to the configuration as described above, the interference of the leakage vortex flow can be evaded; in addition, the flow rate of the fluid flow through the passage 11 and the flow rate of the fluid flow through the passage 13 are equalized. Thereby, the splitter blade 7 divides the flow passage between the adjacent full blades into the flow passages 11 and 13.

In other words, as already explained thus far, on both the surface sides of the splitter blade 7 (i.e. on the splitter blade surface facing the blade suction surface Sb of the front side full blade 5F as well as on the splitter blade surface facing the blade pressure surface Sa of the rear side full blade 5R), the flow speeds are different; thus, the fluid flow of high speed distribution streams mainly and intensively through the passage facing the suction surface Sb. Hence, even when the cross section areas on both the surface sides of the splitter blade 7 are geometrically equalized, the flow speed on the blade suction surface Sb side is higher than the flow speed on the blade pressure surface Sa side. Accordingly, the flow rate on the blade suction surface Sb side becomes greater than the flow rate on the blade pressure surface Sa side; thus, the unevenness of the fluid flow rates in both the flow passages is caused. And, the even distribution of the flow rates can be no longer achieved; further, the blade surface loads become uneven and the flow passage loss is increased. And, there arises a problem that the enhancement of the impeller efficiency is hindered. In dealing with the difficulty as described above, according to the third mode of the present invention, the leading edge of the splitter blade is shifted toward the front side full blade 5F, namely toward the blade suction surface Sb side; and, the section area of the flow passage on the front side full blade 5F side is reduced. In this way, quantity of the fluid flow streaming between the adjacent full blades is equally allotted to the quantities of the fluid flow streaming through the flow passages 11 and 13 into which the fluid flow streaming between the adjacent full blades is divided by the splitter blade 7.

Fourth Mode

Figure 5:
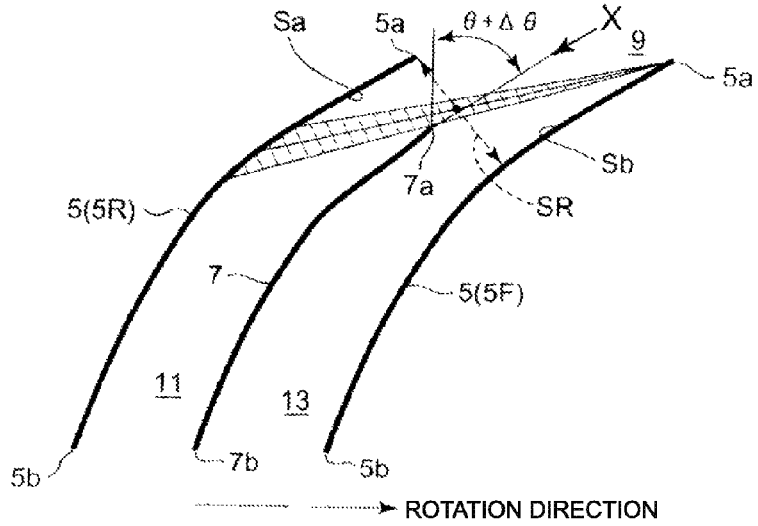
FIG. 5 explains the relationship between a splitter blade and a full blade according to a fourth mode of the present invention, in a cross section.
Figure 6A:
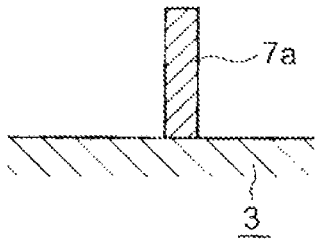
FIGS. 6(*a*), 6(*b*), 6(*c*) and 6(*d*) explain the blade set-up states in response to the X arrow view in FIGS. 2, 3, 4 and 5, respectively.
Figure 6B:
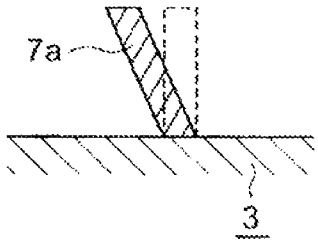
Figure 6C:
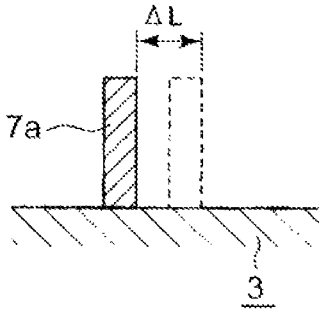
Figure 6D:
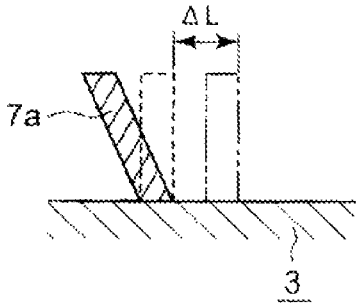

In the next place, based on FIG. 5, a fourth mode of the present invention is now explained.

In this fourth mode, the leading edge 7*a* of the splitter blade 7 in the third mode is inclined toward the front side full blade 5F, as the tip end part (in the height direction) of the leading edge 7*a* of the splitter blade 7 in the second mode is inclined toward the front side full blade 5F.

When the inclination is formed as described, the effect expected from the second mode as well as the third mode can work at the same time. In other words, without placing the leading edge 7*a* of the splitter blade 7 greatly on the downstream side of the fluid flow streaming between the front side full blade 5F and the rear side full blade 5R, the inherent function of the splitter blade for enhancing the pressure ratio as well as the efficiency can work and the length of the splitter blade can be maintained. In addition, the quantity of the fluid flow streaming between the adjacent full blades is equally allotted to the quantities of the fluid flow streaming through the flow passages 11 and 13 into which the fluid flow streaming between the adjacent full blades is divided by the splitter blade 7.

Further, in the explanation thus far, a single splitter blade is provided between a pair of adjacent full blades; it goes without saying that the present invention may be applied to a double splitter blade that is provided in the flow passage between single splitter blades and has the length shorter than the single splitter blade.

INDUSTRIAL APPLICABILITY

According to the present invention, a plurality of full blades provided from the fluid inlet side to the fluid outlet side on the hub surface, the full blades being provided side by side; a plurality of splitter blades provided in the flow passage formed between a pair of the mutual adjacent full blades from a part way of the flow passage to the outlet side, wherein a throat is formed so that a distance from a leading edge of a rear side full blade located on the rear side of the rotation direction of the compressor to a front side full blade adjacent to the rear side full blade and located on the front side of the rotation direction is minimized, and the leading edge of the splitter blade is placed in a fluid flow streaming along the flow passage the full blades, on the downstream side of a leakage vortex line formed to connect the middle location of the throat to the leading edge of the front side full blade.

Accordingly, the interference of the leakage vortex generated at the tip end side of the full blade with the leading edge of the splitter blade can be evaded and the high-pressure ratio and the enhanced efficiency can be achieved. Hence, the present invention can be suitably applicable to the impeller of the compressor, the impeller being provided with a splitter blade.

The invention claimed is:

1. An impeller of a centrifugal compressor, the impeller comprising:

a plurality of full blades provided from a fluid inlet side to a fluid outlet side on a hub surface, the full blades being provided side by side;

a plurality of splitter blades provided in a flow passage formed between a pair of the mutual adjacent full blades from a part way of the flow passage to the outlet side, wherein, in a cross section view depicting a geometry along a tip end curve of the full blades, a leading edge of the splitter blade is placed in a fluid flow streaming along the flow passage between the full blades, on the downstream side of a leakage vortex line formed to connect the middle location of a throat to the leading edge of a front side full blade, the throat being formed so that a distance from a leading edge of a rear side full blade located on the rear side of the rotation direction of the centrifugal compressor to a blade suction surface of the front side full blade adjacent to the rear side full blade and located on the front side of the rotation direction is minimized.

2. The impeller of the centrifugal compressor according to claim 1, wherein a tip end side in the blade height direction of the leading edge of the splitter blade is inclined toward the front side full blade.

3. The impeller of the centrifugal compressor according to claim 2, wherein the inclination angle toward the front side full blade is increased by 5 to 8 degrees with regard to the inclination angle along the rear side full blade.

4. The impeller of the centrifugal compressor according to claim 2, wherein the leading edge of the splitter blade is shifted toward the front side full blade so that the leading edge is closer to the front side full blade in the hoop direction than the middle location between the front side full blade and the rear side full blade.

5. The impeller of the centrifugal compressor according to claim 1, wherein the leading edge of the splitter blade is shifted toward the front side full blade so that the leading edge is closer to the front side full blade in the hoop direction than the middle location between the front side full blade and the rear side full blade.

* * * * *